United States Patent [19]

Thall

[11] 4,006,381

[45] Feb. 1, 1977

[54] CRT WITH THERMALLY-SET GETTER SPRING

[75] Inventor: Earle Solomon Thall, Leola, Pa.

[73] Assignee: RCA Corporation, New York, N.Y.

[22] Filed: Aug. 28, 1975

[21] Appl. No.: 608,563

[52] U.S. Cl. ..... 313/481; 313/405

[51] Int. Cl.[2] ..... H01J 31/00; H01J 29/84

[58] Field of Search ..... 313/481, 178, 174

[56] References Cited

UNITED STATES PATENTS

| | | | |
|---|---|---|---|
| 2,598,241 | 5/1952 | Elenbaas et al. | 315/56 |
| 3,174,851 | 3/1965 | Buehler et al. | 75/170 K |
| 3,634,717 | 1/1972 | Boucher et al. | 313/174 |
| 3,711,734 | 1/1973 | Yamazaki et al. | 313/178 X |

*Primary Examiner*—Robert Segal
*Attorney, Agent, or Firm*—G. H. Bruestle; L. Greenspan

[57] ABSTRACT

A cathode-ray tube comprises a getter container supported on a metal spring which is attached to and extends from the electron-gun mount assembly. At least a portion of the spring consists of an alloy, such as 55-nitinol (an alloy of nickel and titanium), which can be thermally set to a first shape, then cold formed to a second shape, and then restores itself to the first shape upon being heated above a predetermined transition temperature. The method includes providing a spring which has been thermally set and then cold formed, attaching the container to the spring and the spring to the mount assembly, sealing the container and the mount assembly in the tube, and then heating the spring above the predetermined transition temperature.

5 Claims, 7 Drawing Figures

CRT WITH THERMALLY-SET GETTER SPRING

BACKGROUND OF THE INVENTION

In one popular design of a cathode-ray tube for use in a television display, a getter container is carried or supported on a leaf spring that is attached to and extends from the electron-gun mount assembly. This combination is sometimes referred to as an antenna getter assembly. With the getter container supported in this fashion from the mount assembly, the getter container can be located in an area of the tube where it is more effective for flashing the getter material and, at the same time, can be removed and replaced with the mount assembly should the tube be regunned.

The spring itself usually consists of a spring steel ribbon that is shaped as an arc of a circle. One end of the ribbon is welded to the mount assembly and the other end is welded to the getter container. When the mount assembly and getter assembly are installed in the tube through the neck thereof, the spring extends toward the tube target and away from the longitudinal axis of the tube. Because of its arcuate shape and spring characteristic, the spring urges the getter container against the inner funnel wall of the tube. A typical shadow-mask-type tube of this design is described in U.S. Pat. No. 3,508,105 to N. P. Pappadis.

The getter container is usually provided with runners so that when the container is pushed into the tube during installation, it will slide over the inner surface of the tube envelope and over the inner coatings thereon. Unfortunately, the runners chip or/and scrape off particles of coating material and, in some cases, particles of envelope material. Particles of any type are detrimental to the tube performance. Conducting particles can cause arcing and stray emissions especially in the mount assembly. Insulating particles can collect electrostatic charges and cause localized distortions in the internal electric fields and in the electron beam path. Insulating particles are particularly undesirable when they settle on the shadow mask of the tube.

In order to avoid contacting the getter container and/or the runners with the inner surfaces of the envelope during installation, U.S. Pats. Nos. 3,711,734 to E. Yamazaki et al and 3,848,154 to R. J. Bowes et al each propose employing a bimetal spring. In both proposals, the spring is essentially straight when the getter container is pushed into the tube envelope and subsequently becomes arcuate. In the former patent, the bimetal spring is hot when installed and becomes arcuate upon cooling. In the latter patent, the spring is cool when installed and, when heated above some threshold temperature, one metal experiences a permanent dimensional change, which persists upon cooling, and the spring becomes arcuate.

SUMMARY OF THE INVENTION

The novel tube comprises an antenna getter structure wherein at least a portion, and preferably all, of the spring consists of an alloy; such as 55-nitinol (an alloy of nickel and titanium), which can be thermally set to a first shape, then cold formed to a second shape, and then will spontaneously restore itself to said first shape when it is heated above a predetermined transition temperature which is preferably above about 50° C.

In the novel method, a spring is provided which is thermally set to the desired first shape for the finished tube, which first shape any may be arcuate as in prior designs, or may be of more complex shapes which may better conform to the inner surface of the tube, or can orient the getter container to provide a better distribution of getter material in the tube. The thermally-set spring is cold formed to a second shape such that the inner surface of the tube need not be touched when the getter container is inserted in the tube. The thermally-set and cold-formed spring is attached to the getter container and mount assembly, the container and mount assembly are inserted in the envelope without substantial touching of the inner walls or coatings of the envelope, and the mount assembly is sealed to the envelope. Then, the spring is heated above the transition temperature of the alloy until it is restored to the desired first shape.

By employing the novel tube and method, the amount of generated particles is markedly reduced as compared with what is produced with prior monometal springs. As compared to prior bimetal springs, the novel tube and method employ a spring that has a simpler one-piece construction and can be made conveniently in complex shapes and cross sections.

A further problem with prior antenna getters is that the metal springs tend to tangle with one another when a group of them is being handled, as in packing, unpacking and shipping, prior to installation in tubes. By employing a substantially straight shape, and preferably more rigid than before, this tendency is markedly reduced. Greater rigidity can be achieved by providing a nonplanar cross section to the spring.

DESCRIPTION OF THE PREFERRED EMBODIMENT

Figure 1:
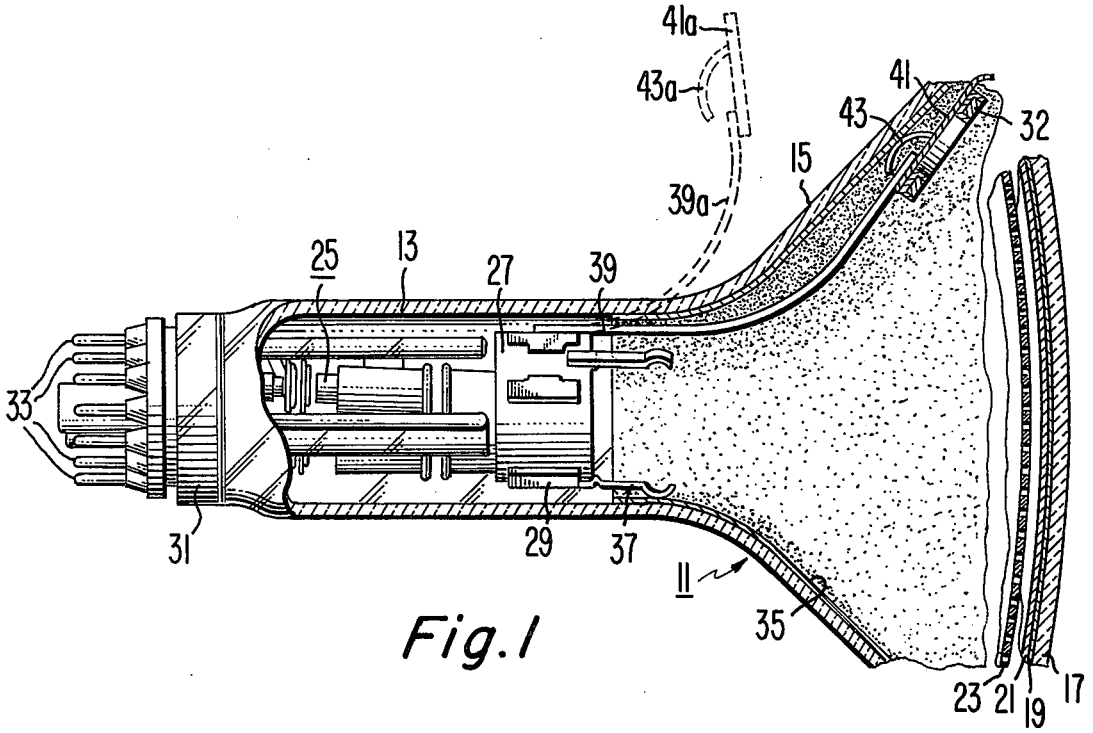
FIG. 1 is a fragmentary view, partially in cross section, of a cathode-ray tube including an antenna getter structure in accordance with the invention.

FIG. 1 shows so much of a color television picture tube as is necessary for understanding the invention. Except for the spring on the getter assembly, the tube is of a conventional construction. The tube is comprised of an evacuated glass envelope 11 including a cylindrical neck 13 extending from the small end of a funnel 15. The large end of the funnel 15 is closed by a fireplate panel 17. A tricolor mosaic screen 19, which is backed by a reflecting metal layer 21 of aluminum, is supported on the inner surface of the faceplate panel 17. The screen 19 comprises a multiplicity of triads, each including a green-emitting, a red-emitting and a blue-emitting element. A shadow mask 23 is supported within the envelope close to the screen 19 to achieve color selection. The mask 23 is a metal sheet having a generally dome-shaped configuration and provided with an array of apertures which are geometrically related to the triads in the screen 19.

A electron-gun mount assembly 25 comprises an array of three similar electron guns arranged in delta pattern and geometrically converged. Each of the guns comprises a cathode for emitting electrons, grids for forming the electrons into a beam and for modulating the beam, and other electrodes for focusing and accelerating the beams toward the mask 23 and screen 19. A convergence cage 27, which supports pole pieces 29, is that element of the mount assembly 25 closest to the screen 19. The end of the neck 13 is closed by a stem 31 having terminal pins or leads 33 on which the mount assembly 25 is supported and through which electrical connections are made to the various elements of the mount assembly 25, except the convergence cage 27 and the final electrode.

A conductive coating 35 of graphite on the inner surface of the envelope 11 provides a connection from a high-voltage terminal or anode button (not shown) in the funnel 15 to the convergence cage 27 and the final electrode. The connection is completed from the coating 35 to the convergence cage 27 through bulb spacers 37 which are welded to the cage 27 at one end and are urged outwardly against the coating 35 at the other end. The bulb spacers 37 also center and position the extended end of the mount assembly 25 with respect to the longitudinal axis of the tube. The bulb spacers 37 are preferably made of spring steel. If it is desired to retract the extended ends of the spacers from the inner surface of the neck while assembling the tube, the spacers may be made of a bimetal or of a nitinol alloy of the type described below.

The getter assembly comprises an elongated spring 39 attached at one end to the cage 27 of the mount assembly 25 and projecting into the funnel 15 of the envelope. A getter container 41 is attached to the other end of the spring 39 and a sled with two curvilinear runners 43 is attached to the bottom of the container 41. The container 41 has a ring-shaped channel 32 having a closed base facing the inside wall of the funnel 15. The spring 39 is of a single alloy composition of 54.5-nitinol. Particularly, the alloy consists essentially of about 54.5 weight percent nickel and 45.5 weight percent titanium. The spring 39 is a ribbon of metal which has a length very much greater than its width. When unflexed and unrestrained, the spring has a configuration conforming to an arc of a circle of about 4.5-inch radius, as shown by phantom lines 39*a*. However, in the tube, the spring 39 is restrained so as to urge the container 41 outwardly with the runners 43 contacting the coating 35. The length of the spring 39 permits the container 41 to be positioned well within the funnel 15 close to the inner surface of the funnel 15, where the getter material can be flashed to provide optimum coverage and where the spring 39 and container 41 will be disposed out of the path of the electron beam and not interfere with the operation of the tube. Yet, should the tube need to be regunned, the spring 39 and container 41 can be removed and replaced with the mount assembly 25.

During assembly of the tube, the getter assembly is assembled separately. The runners 43 are welded to the bottom of the getter container 41, and the getter container 41 is filled with getter material. The spring 39 is provided already thermally set and cold formed. To set the spring 39, a length of the desired alloy ribbon is wound upon a cylindrical mandrel of about 3.5 inches in diameter and then heated to about 500° C in the air for about 10 minutes. The ribbon, still on the mandrel, is then cooled to room temperature. This procedure thermally sets the ribbon to a curved or arcuate shape to which it will later revert. The ribbon is now removed from the mandrel and rolled or otherwise cold formed to a shape that is curved slightly in the opposite direction. The ribbon is then cut to length and one end welded to the bottom of the container 41. The other end is then welded to the convergence cage 27.

Figure 2:
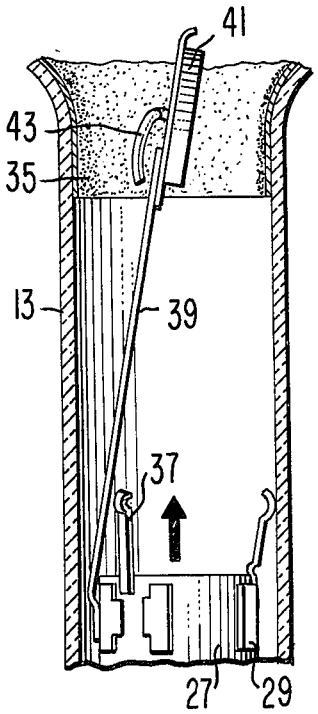
FIG. 2 is a fragmentary sectional view of a partially-assembled tube showing the insertion of the getter assembly and mount assembly into the envelope.

When the tube is ready for the installation of the mount assembly 25, the getter container 41 and spring 39 are inserted in the direction shown by the arrow into the neck 13 and funnel 15 substantially without touching the envelope walls or the coating 35. The slight inward curvature of the spring 39 locates the container 41 on the axis of the mount assembly 25 as shown in FIG. 2. Since the coating 35 is not touched, no particles are liberated from the coating. If, by accident, the coating 35 is touched, there is no spring pressure urging the runners 43 against the coating 35, so substantially no particles are liberated. With the mount assembly 25 in the desired position in the neck 13, the stem 31 is sealed to the neck 13. After sealing, the getter container 41 remains along the axis of the tube.

The tube is now baked and exhausted to remove as much gas as possible from the tube. While hot and exhausted, the tube is "tipped off," that is, the glass exhaust tubulation (not shown) in the stem is closed, and the tube interior is thereby sealed from the atmosphere. During the baking, the tube and its parts are heated to about 400° C. During this heating, and particularly above about 100° C, the spring 39 spontaneously restores itself to the thermally-set configuration shown by the phantom lines 39*a* in FIG. 1. Since the funnel 11 is in the way, the spring 31 assumes the shape shown in FIG. 1 and applies a spring pressure urging the container 41 and runners 43 against the coating 35. When the tube cools, the getter assembly remains in this position. The tube is now processed in the usual way including the steps of getter flashing, cathode activation and electrode processing to complete the making of the tube.

GENERAL CONSIDERATIONS

Any cathode-ray tube employing an antenna getter assembly may use the spring described herein. The antenna getter described herein can be used with tubes of different gun or screen constructions; for example, with in-line guns, single guns, line screens, penetration screens, monochrome screens and cascade screens. The tubes may be used for direct-view television displays, projection television or other purposes for which cathode-ray tubes are used.

The spring is preferably made of a ribbon of a single thermally-settable alloy throughout. However, the spring may be made of a composite structure. For example, the spring may be made in two parts which are butt welded or lap welded together with the one portion of a thermally-set alloy attached to the cage and the other portion of a chromium steel alloy attached to the container. Or the one portion may be of a steel alloy and the other portion may be of a thermally-set alloy. Or both portions may be of thermally-set alloys with different settings and/or different transition temperatures. The spring may be made in more tha two parts, some or all of which are of a thermally-settable alloy.

One family of suitable thermally-settable alloys is the nitinol alloys. The nitinol alloys are described in U.S.

Figure 3:
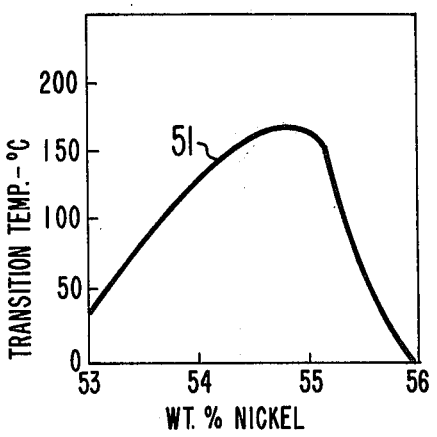
FIG. 3 is a graph showing the variation of transition temperature with variation in composition of 55-nitinol alloys.

Pat. No. 3,174,851 to W. J. Buehler et al, and in W. J. Buehler et al, *Ocean Engineering* Vol. 1, pp. 105-120 (1968). The name nitinol is derived from Ni-Ti-Nol. The prefix numeral value (e.g., 55-nitinol) indicates the nominal nickel content in weight percent, balance titanium. Generally, the usable alloys contain about 53 to 55½ weight percent nickel and 47 to 44½ weight percent titanium. The transition temperature range; that is, the temperatures at which bodies of the alloy restore themselves to the thermally-set shape from the cold-formed shape, is between about 50° and 166° C as shown by the curve 51 in FIG. 3. The highest transition temperature is for an alloy containing about equal atomic amounts of nickel and titanium. Substituting cobalt for a portion of the nickel lowers the transition temperature. Any transition temperature above room temperature (20° C) can be used for the novel tube. However, in practice it is preferred to use alloys with transition temperatures above 50° C and preferably above 100° C as a matter of convenience.

Figure 4:
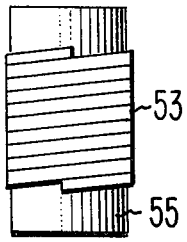
FIGS. 4 and 5 are elevational views illustrating methods for restraining metal springs while they are being thermally set.
Figure 5:
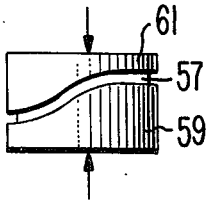

The spring which is simplest and easiest to set and form is a flat, enlongated piece with rectangular cross section. Typically, a ribbon about 15 mils thick and 150 mils wide is employed. One method to thermally set a metal ribbon is to wrap a ribbon 53 spirally around a cylinder 55 as shown in FIG. 4. If desired, the ribbon can be wound over itself to provide two or more layers on the cylinder. Still another alternative is to wind several layers of ribbon on itself on a spool. In any of these alternatives, the ribbon is held in place and heated in an air furnace to temperatures above about 500° C, for example about 525° C until the temperature has equalized through the mass. Then, with the ribbon still held in place, the mass is cooled in air, or is water or air quenched to room temperature.

Where complex shapes are to be produced by thermal setting, other techniques can be used. For example, one or more lengths 57 of ribbon can be placed between mold sections 59 and 61 and pressure applied as shown by the arrows in FIG. 5. The mold with the pressure applied is heated above 500° C and then cooled to room temperature as described above.

Figure 6:
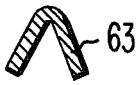
FIGS. 6 and 7 are cross-sectional views of springs which may be provided either after thermal setting or after cold forming.
Figure 7:
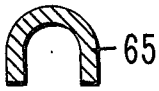

After thermal setting, the ribbon may be cold formed to a desired shape. Cold forming may be done manually. For flat ribbons, rollers may be used to produce straight or substantially straight ribbon, after which the ribbon is cut to length (about 4½ inches for the example above). If a cold-formed spring of greater rigidity is desired, the flat thermally-set ribbon may be cold formed to a V-shaped cross section 63 shown in FIG. 6 or to a U-shaped cross section 65 shown in FIG. 7 or to any other nonplanar cross section. Similarly, the ribbon may be thermally set to U-shaped, or V-shaped, or other nonplanar cross section if a more rigid spring is desired in the finished tube. A more rigid spring in the finished tube may be desirable to prevent movement of the antenna getter structure during shipping. Nonplanar cross sections may be produced by passing the metal ribbon between suitably-shaped rollers.

The spring may also be thermally set so that, after reheating to restore the spring to its thermally-set shape, the getter container is given an attitude with respect to the funnel walls which is more suitable to the flashing and deposition of the getter material. The getter container may be made to face more toward the mount assembly and less toward the screen, for example. This can be done by small changes in configuration in the ¾ inch of spring closest to the container.

I claim:

1. A cathode-ray tube comprising an envelope, an electron-gun mount assembly in said envelope, a metal spring connected at one end to said mount assembly and a getter container connected at the other end of said spring, said container being urged toward the inner wall of said envelope by said spring, at least a portion of said metal spring consisting essentially of a nitinol metal alloy which can be thermally set to a prescribed first shape whereby said spring urges said container outwardly toward the inner wall of said envelope, then cold formed to a prescribed second shape, whereby said spring does not urge said container outwardly toward the inner wall of said envelope, and then when heated above predetermined temperatures reverts to said first shape.

2. The tube defined in claim 1 wherein said spring is a leaf spring and has a nonplanar cross section in said thermally-set condition.

3. The tube defined in claim 1 wherein the cross section of said thermally-set spring prior to cold forming is substantially V-shaped or U-shaped.

4. The tube defined in claim 1 wherein said spring is entirely of said metal alloy.

5. The tube defined in claim 1 wherein said spring consists essentially of 53 to 55½ weight percent nickel and 47 to 44½ weight percent titanium.

* * * * *

UNITED STATES PATENT OFFICE
CERTIFICATE OF CORRECTION

PATENT NO. : 4,006,381

DATED : February 1, 1977

INVENTOR(S) : Earle Solomon Thall

It is certified that error appears in the above-identified patent and that said Letters Patent are hereby corrected as shown below:

| | |
|---|---|
| Title | after "set" insert --nitinol-- |
| Column 2, lines 57 and 58 | change "fireplate" to --faceplate-- |
| Column 3, line 67 | after "in" remove --the-- |

Signed and Sealed this

Seventeenth Day of May 1977

[SEAL]

*Attest:*

RUTH C. MASON
*Attesting Officer*

C. MARSHALL DANN
*Commissioner of Patents and Trademarks*